US010539109B2

(12) United States Patent
Rodriguez et al.

(10) Patent No.: US 10,539,109 B2
(45) **Date of Patent: *Jan. 21, 2020**

(54) FLUSHING OF FUEL NOZZLE ASSEMBLY OR COMPONENT USING A SOLUTION FOLLOWING ULTRASONIC CLEANING

(71) Applicant: STANDARD AERO (SAN ANTONIO) INC., San Antonio, TX (US)

(72) Inventors: Daniel Rodriguez, San Antonio, TX (US); Ulises Noguera, San Antonio, TX (US)

(73) Assignee: STANDARD AERO (SAN ANTONIO) INC., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/977,611

(22) Filed: May 11, 2018

(65) Prior Publication Data

US 2018/0258895 A1 Sep. 13, 2018

Related U.S. Application Data

(63) Continuation of application No. 14/631,594, filed on Feb. 25, 2015, now Pat. No. 9,995,263.

(51) Int. Cl.

| | |
|---|---|
| ***F02M 65/00*** | (2006.01) |
| ***B08B 7/02*** | (2006.01) |
| ***B08B 9/027*** | (2006.01) |
| ***B08B 9/032*** | (2006.01) |

(52) U.S. Cl.

CPC ..... *F02M 65/008* (2013.01); *B08B 7/028* (2013.01); *B08B 9/027* (2013.01); *B08B 9/032* (2013.01)

(58) Field of Classification Search

CPC ..... B08B 7/028; B08B 9/027; B08B 3/12; F02M 65/007; F02M 65/008

See application file for complete search history.

(56) References Cited

U.S. PATENT DOCUMENTS

| | | | |
|---|---|---|---|
| 3,601,135 | A | 8/1971 | Marlow et al. |
| 4,082,565 | A | 4/1978 | Sjolander |
| 4,167,193 | A | 9/1979 | Magnus et al. |
| 4,170,489 | A | 10/1979 | Magnus et al. |
| 4,693,224 | A | 9/1987 | McKay |
| 4,788,858 | A | 12/1988 | Liebermann |
| 4,845,979 | A | 7/1989 | Farenden et al. |
| 5,000,043 | A | 3/1991 | Bunch, Jr. et al. |
| 5,213,117 | A | 5/1993 | Yamamoto |
| 5,295,497 | A | 3/1994 | Skovron |
| 5,339,845 | A | 8/1994 | Huddas |
| 5,937,875 | A | 8/1999 | Nygren |

(Continued)

FOREIGN PATENT DOCUMENTS

WO 00/63552 A1 10/2000

*Primary Examiner* — Mikhail Kornakov
*Assistant Examiner* — Natasha N Campbell
(74) *Attorney, Agent, or Firm* — Greenberg Traurig LLP

(57) ABSTRACT

Fuel nozzle assemblies are flushed after ultrasonic cleaning. In one embodiment, a method includes: cleaning a fuel nozzle assembly by ultrasonic cleaning; and after the ultrasonic cleaning, flushing the fuel nozzle assembly using a solution, the fuel nozzle assembly comprising a valve located in an interior of the fuel nozzle assembly, the solution flowing through the interior of the fuel nozzle assembly, and the flowing of the solution controlled by the valve.

20 Claims, 5 Drawing Sheets

(56) References Cited

U.S. PATENT DOCUMENTS

| | | | |
|---|---|---|---|
| 5,985,038 | A | 11/1999 | Dawson |
| 6,234,002 | B1 | 5/2001 | Sisney et al. |
| 6,471,328 | B1 | 10/2002 | Becker et al. |
| 6,564,814 | B2 | 5/2003 | Bowsman et al. |
| 6,732,751 | B2 | 5/2004 | Chiang |

FLUSHING OF FUEL NOZZLE ASSEMBLY OR COMPONENT USING A SOLUTION FOLLOWING ULTRASONIC CLEANING

RELATED APPLICATIONS

This is a continuation application of U.S. Non-Provisional application Ser. No. 14/631,594, filed Feb. 25, 2015, now issued as U.S. Pat. No. 9,995,263, entitled "FLUSHING OF FUEL NOZZLE ASSEMBLY OR COMPONENT USING A SOLUTION FOLLOWING ULTRASONIC CLEANING," by Rodriguez et al., the contents of which application is incorporated by reference in its entirety as if fully set forth herein.

FIELD OF THE TECHNOLOGY

At least some embodiments disclosed herein relate to cleaning of fuel nozzle assemblies or components in general, and more particularly, but not limited to, flushing of a fuel nozzle assembly or component using a solution following ultrasonic cleaning of the fuel nozzle assembly or component.

BACKGROUND

Fuel injectors are used in various fuel injection systems to provide a more accurate metering of the quantity of fuel supplied to, for example, each of the cylinders of a motor or engine, and to provide better control of the fuel/air ratio. Each fuel injector opens and closes to inject fuel at a timed interval. In operation, the fuel injectors gradually acquire deposits that restrict fuel passages in the injector.

There are various prior methods of cleaning electronic fuel injectors. For example, a first method immerses the injectors in an ultrasonic bath of cleaning fluid. Fuel injectors also may be cleaned by ultrasonic cleaning.

A fuel nozzle is another way that fuel may be provided to an engine. In contrast to a fuel injector, a fuel nozzle stays open during operation and produces a constant spray pattern.

SUMMARY OF THE DESCRIPTION

Systems and methods to flush a fuel nozzle assembly or component using a solution following ultrasonic cleaning of the fuel nozzle assembly or component are described herein. Some embodiments are summarized in this section.

In one embodiment, a method includes: after a fuel nozzle assembly or component has been cleaned by ultrasonic cleaning, flushing the fuel nozzle assembly or component using a solution flowing in a pressurized system, wherein the flowing of the solution through the fuel nozzle assembly or component is initiated when a pressure of the solution reaches at least a preset value (e.g., an opening or release value for a metering valve of a fuel nozzle assembly). In one example, a metering valve is flushed by mounting the metering valve in a slave fuel nozzle assembly used solely for flushing purposes in a cleaning system. After flushing, the metering valve is re-installed in its operational fuel nozzle assembly for actual production use.

In another embodiment, a method includes cleaning a fuel nozzle assembly by ultrasonic cleaning; and after the ultrasonic cleaning, flushing the fuel nozzle assembly using a solution, the fuel nozzle assembly comprising a valve located in an interior of the fuel nozzle assembly, the solution flowing through the interior of the fuel nozzle assembly, and the flowing of the solution controlled by the valve.

The disclosure includes methods and apparatuses which perform these methods, including pressurized cleaning systems which perform these methods.

Other features will be apparent from the accompanying drawings and from the detailed description which follows.

BRIEF DESCRIPTION OF THE DRAWINGS

The embodiments are illustrated by way of example and not limitation in the figures of the accompanying drawings in which like references indicate similar elements.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
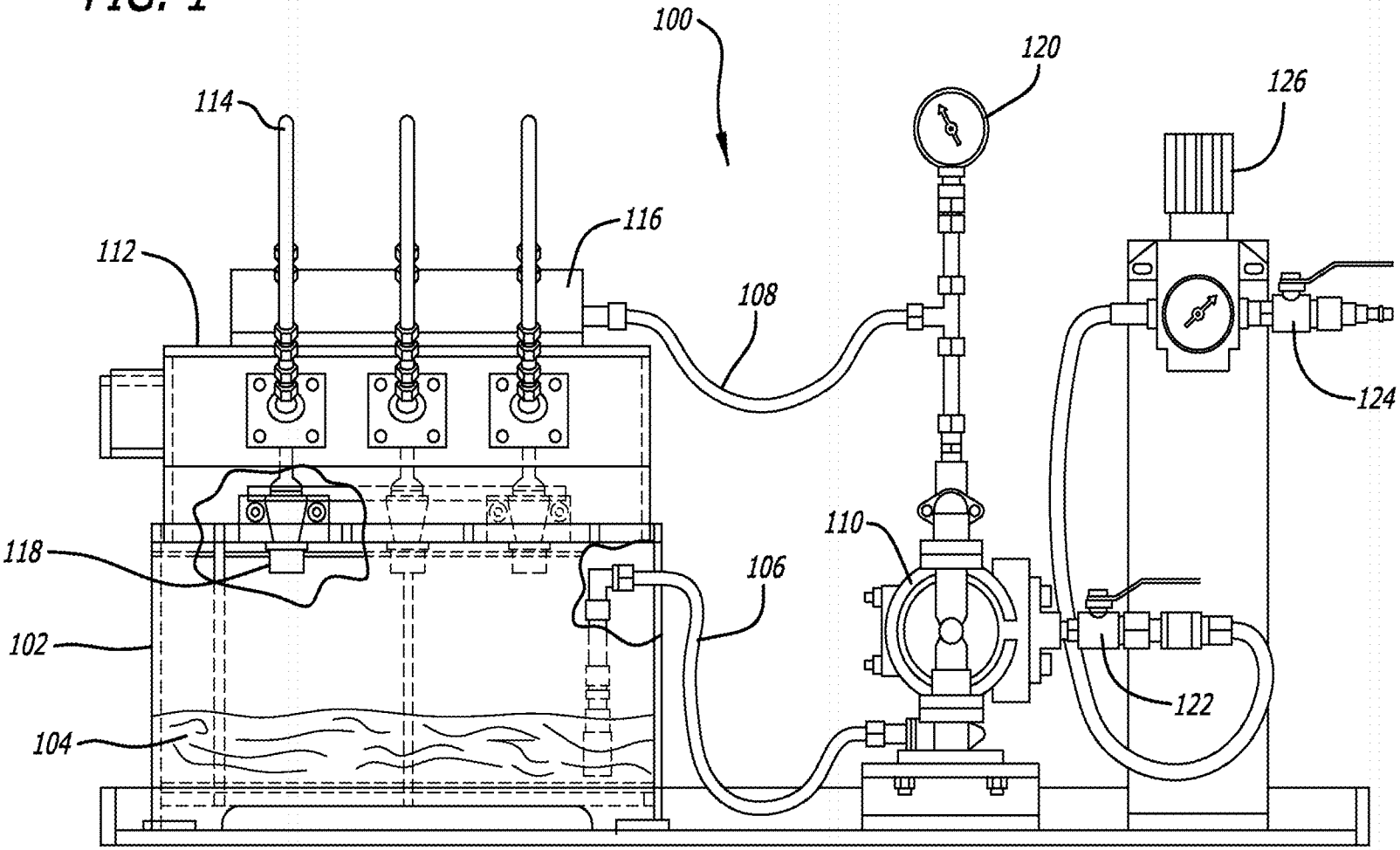
FIG. 1 shows a pressurized cleaning system for flushing a fuel nozzle assembly, according to one embodiment.

FIG. 1 shows a pressurized cleaning system 100 for flushing a fuel nozzle assembly after ultrasonic cleaning of the fuel nozzle assembly, according to one embodiment. A solution tank 102 holds a cleaning solution 104, which is withdrawn by hose 106 and circulated within the system by pump 110 supplying the cleaning solution 104 to a manifold 116 via a supply hose 108. Manifold 116 distributes and directs the cleaning solution to a number of tubes 114, each connected to a fuel nozzle assembly 118 (illustrated in FIG. 1 by a partial cut-away view).

Several fuel nozzle assemblies are mounted above solution tank 102 using a fuel nozzle holder 112. Each fuel nozzle assembly is positioned so that the cleaning solution supplied by manifold 116 flows through an interior of the assembly into the bottom of the solution tank 102, for recirculation within the system 100 as described above.

Pump gauge 120 permits monitoring of the pressure build-up within system 100. Air supply valve 124 permits turning on and off supplied air to the cleaning system 100. Air pressure regulator 126 regulates this inlet air pressure to prevent damage to the pump 110 and/or injury to persons operating the system. Pump valve 122 provides a way to turn off the pump 110 without having to disconnect the air supply. Pump gauge 120 also may be used to confirm that metering valves contained in each of the fuel nozzle assemblies being flushed (the metering valves are not shown in FIG. 1; see FIG. 4 below) are opening and closing at approximately the correct preset pressure value.

Figure 2:
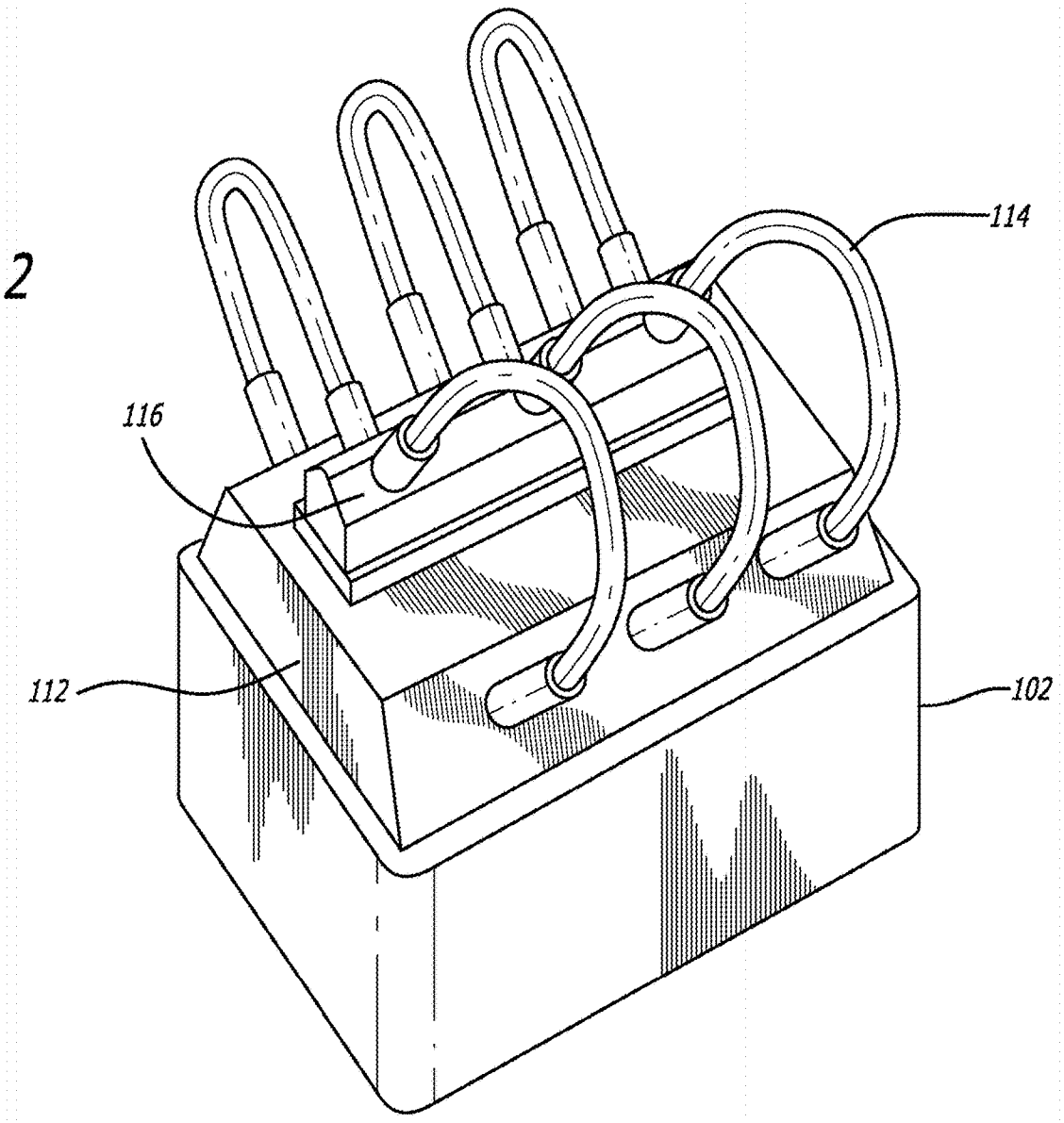
FIG. 2 shows a perspective view of the cleaning system of FIG. 1.

FIG. 2 shows a perspective view of the cleaning system 100 of FIG. 1. In FIG. 2, fuel nozzle holder 112 is shown overlying solution tank 102. Manifold 116 distributes cleaning solution to tubes 114, as was discussed above.

Figure 3:
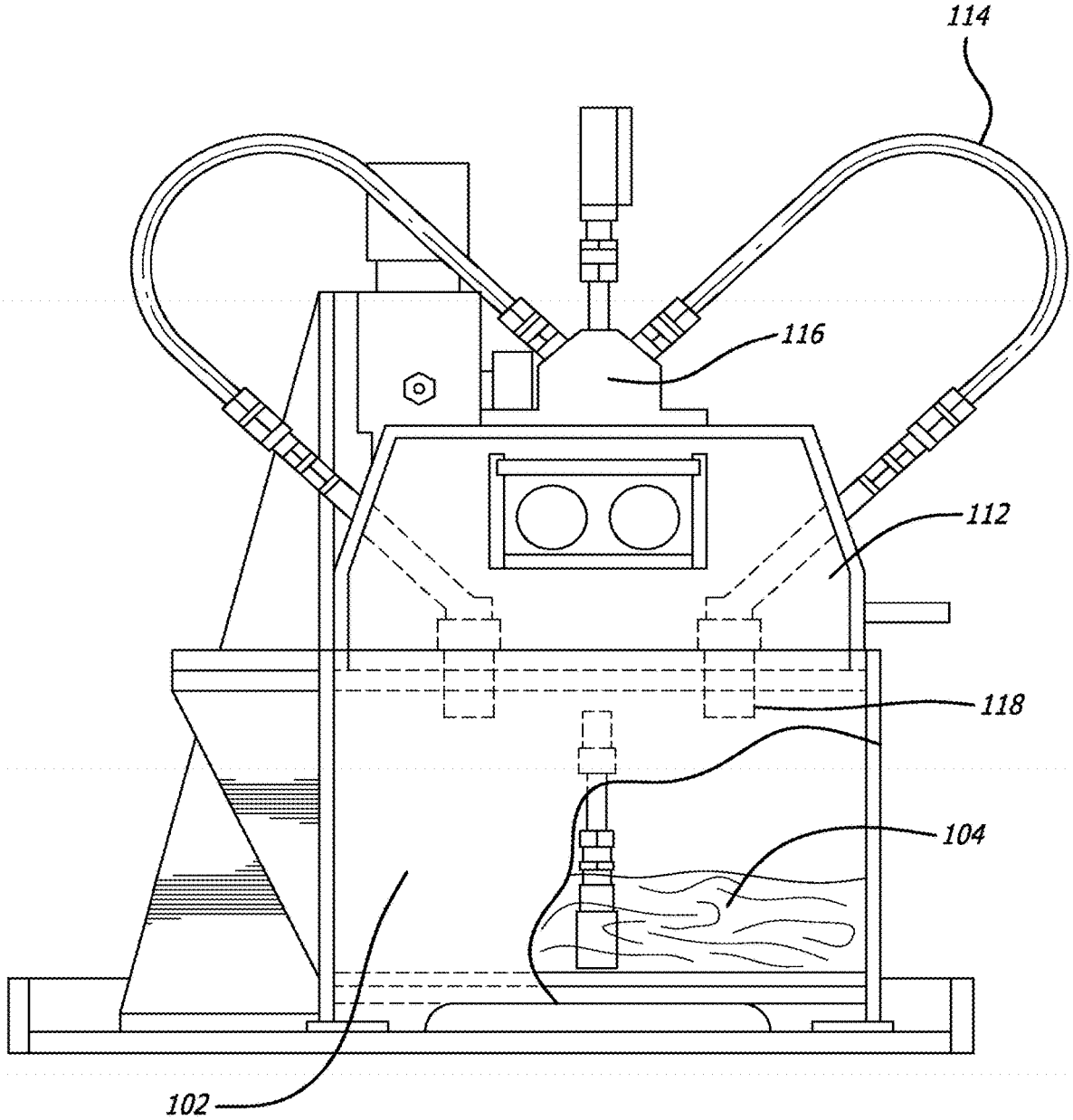
FIG. 3 shows an end view of the cleaning system of FIG. 1.

FIG. 3 shows an end view of the cleaning system 100 of FIG. 1. More specifically, FIG. 3 illustrates manifold 116 distributing flowing cleaning solution to tubes 114, as discussed above. Each fuel nozzle assembly 118 is mounted in a fixed manner to fuel nozzle holder 112. Fuel nozzle assembly 118 is positioned so that cleaning solution flowing through an interior of the fuel nozzle assembly 118 is directed downwards towards the lower portion of solution tank 102. Cleaning solution flowing out of fuel nozzle assembly 118 collects as cleaning solution 104 at the bottom of solution tank 102. Tubes 114 may be, for example, clear plastic hoses.

Figure 4:
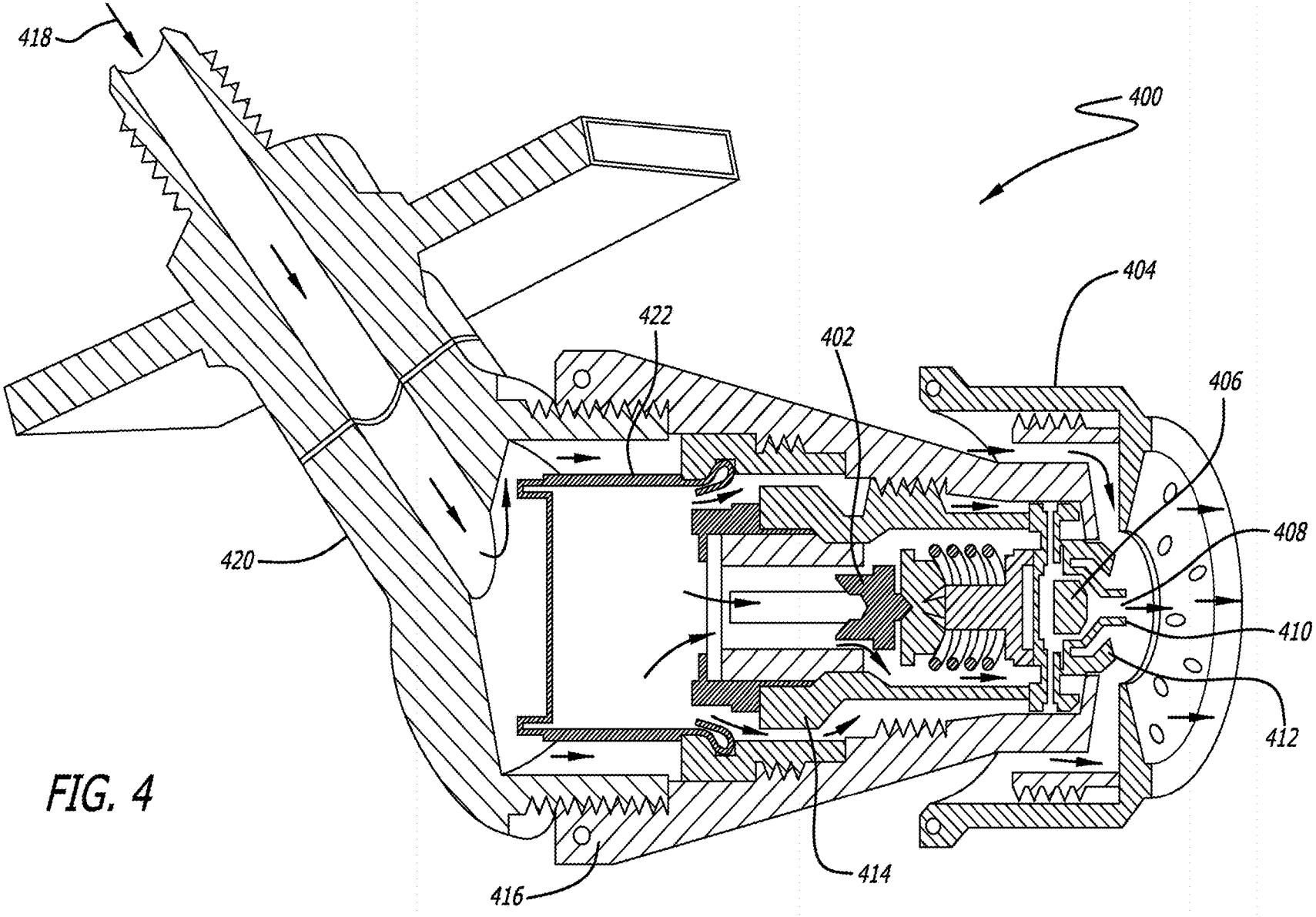
FIG. 4 shows a cross-section of a fuel nozzle assembly, according to one embodiment.

FIG. 4 shows a cross-section of a fuel nozzle assembly 400, according to one embodiment. In one example, fuel nozzle assembly 400 is used as the fuel nozzle assembly 118 of FIG. 1 above.

Fuel nozzle assembly 400 includes a nozzle body 416 mounted to a nozzle body holder 420. Cleaning solution flows through an interior of fuel nozzle assembly 400 as indicated by arrows 418. Fuel nozzle assembly 400 also includes a screen filter 422 and a valve cage 414.

A metering valve 402 is located in the interior of nozzle body 416. Metering valve 402 opens to permit fluid flow when a liquid pressure increases to and reaches a preset value. This pressure release value may be established by the manufacturer of the valve, or in other cases may be set by a person assembling or maintaining the fuel nozzle. In one example, the metering valve has a pressure limit that is set prior to installing or mounting for flushing in the cleaning system.

In operation, the liquid pressure of the cleaning solution increases as pump 110 is operated. When metering valve 402 opens, the cleaning solution starts flowing to remove debris from the interior of fuel nozzle assembly 400 that has accumulated during prior ultrasonic cleaning of fuel nozzle assembly 400. The effect of the initial flushing action is to remove debris out of the metering set that includes metering valve 402.

An air shroud 404 is positioned on the end of nozzle body 416. Also located at this end are an inner spray tip 410 and an outer spray tip 412. Inner spray tip 410 includes primary orifice 408.

Figure 5:
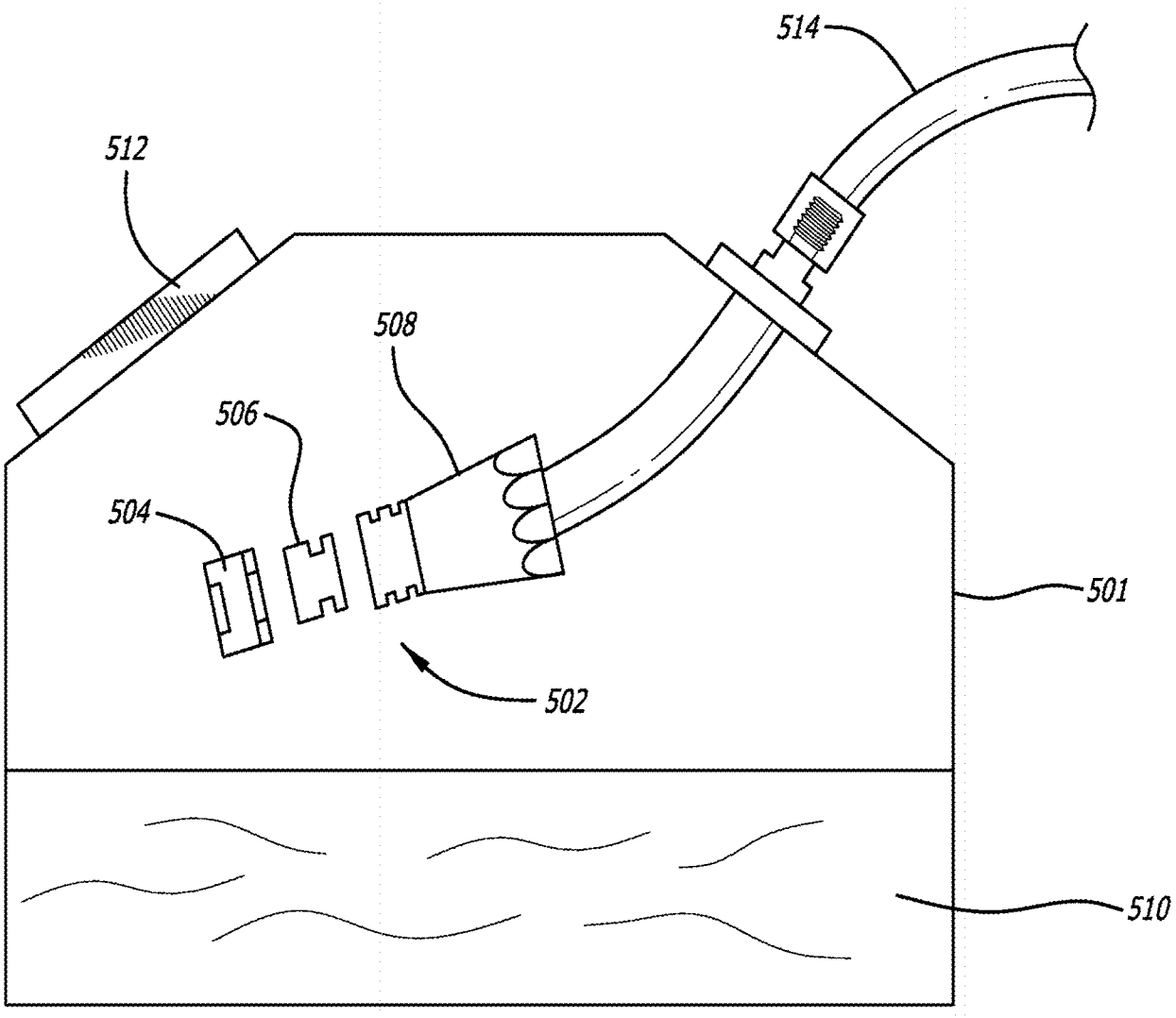
FIG. 5 shows a partially-exploded view of a fuel nozzle assembly that protrudes into a solution tank of a pressurized cleaning system, according to an alternative embodiment.

FIG. 5 shows a partially-exploded view of a fuel nozzle assembly 502 that protrudes into a solution tank 501 of a pressurized cleaning system, according to an alternative embodiment. More specifically, cleaning solution flowing from inlet tube 514 through the fuel nozzle assembly 502 collects as a body of liquid 510 at the bottom of solution tank 501.

Fuel nozzle assembly 502 includes a shroud 504 that mounts over a spray tip 506 onto a body 508. In one example, other components of the cleaning system may be similar to those components discussed above for FIG. 1, and are not shown in FIG. 5 for simplicity of illustration. A glass cover or portal 512 permits visual inspection of the fuel nozzle assembly 502 during the flushing process.

As one example, during a prior ultrasonic cleaning of fuel nozzle assembly 502, spray tip 506 is a component that contains entrapped debris from the ultrasonic cleaning. According to one embodiment, this debris is fully or partially flushed away during the flushing process as described above.

In other embodiments, spray tip 506 may have been previously cleaned on a different fuel nozzle assembly, but mounted onto "slave" fuel nozzle assembly 502 solely for the purpose of flushing as described above. After flushing, spray tip 506 is re-assembled into its operational fuel nozzle assembly for use, for example, during flight operations of an airplane. The flushing process described herein may be used, for example, for numerous types of fuel nozzles/assemblies, and for numerous types of vehicles and/or engines.

Various, additional embodiments are now described below. In a first embodiment, a method includes: cleaning a fuel nozzle assembly by ultrasonic cleaning; and after the ultrasonic cleaning, flushing the fuel nozzle assembly using a solution, the fuel nozzle assembly comprising a valve located in an interior of the fuel nozzle assembly, the solution flowing through the interior of the fuel nozzle assembly, and the flowing of the solution controlled by the valve. The valve opens to start the flowing of the solution when a preset pressure value of the valve is reached.

In another embodiment, the solution is a cleaning solution, and the method further comprises flushing the interior with a calibration fluid. In one embodiment, the fuel nozzle assembly further comprises a spray tip, the spray tip includes inner cavities with residual debris from the ultrasonic cleaning, and the flowing of the solution removes at least a portion of the residual debris.

The valve is a metering valve adjusted to open when a liquid pressure of the solution is at least a preset value. In one example, the preset value is 40 pounds per square inch (PSI). In another example the metering valve may be preset to open at a pressure of 60 PSI. The valve pressure may be adjusted, for example, by loosening a lock nut of a valve cage (valve housing). The valve cage is then turned and the lock nut secures the location of the valve cage.

In one embodiment, the fuel nozzle assembly further comprises a spray tip mounted to the fuel nozzle assembly prior to the flushing. The fuel nozzle assembly further comprises a metering set (e.g., a metering set typically includes an inner and outer spray tip along with other related components), and the flushing comprises flushing inner cavities of the metering set. The flushing of the inner cavities of the metering set removes at least a portion of debris entrapped during the ultrasonic cleaning.

In one embodiment, the solution is a liquid detergent. The solution is pressurized during the flushing by providing the solution to the fuel nozzle assembly using a pump to flow the solution within a pressurized system, the system comprising a solution tank and a manifold overlying the solution tank, and the manifold receiving the solution from the pump and directing the solution to the fuel nozzle assembly during the flushing.

In another embodiment, a method includes: cleaning a metering valve by ultrasonic cleaning; and after the ultrasonic cleaning, flushing the metering valve using a solution, wherein the metering valve is located in an interior of a fuel nozzle assembly during the flushing, the solution flows through the interior of the fuel nozzle assembly, and the flowing of the solution through the interior begins after a pressurizing of the solution causes an opening of the metering valve. The pressurizing of the solution is performed by providing the solution to the fuel nozzle assembly using a pump to flow the solution within a pressurized cleaning system.

In one embodiment, the cleaning system includes a solution tank and a manifold overlying the solution tank. The manifold receives the solution from the pump and directs the solution to the fuel nozzle assembly during the flushing.

In yet another embodiment, a method includes: after a fuel nozzle assembly or component has been cleaned by ultrasonic cleaning, flushing the fuel nozzle assembly or component using a solution flowing in a pressurized system, wherein the flowing of the solution through the fuel nozzle assembly or component is initiated when a pressure of the solution is at least a preset value. The component is located in an interior of a fuel nozzle assembly, and the solution flows through the interior during the flushing.

In one embodiment, the fuel nozzle assembly comprises a metering valve located in an interior of the fuel nozzle assembly, the metering valve opens to start the flowing of the solution when the pressure is at least the preset value, and the solution flows through the interior of the fuel nozzle assembly.

In an alternative embodiment, the starting of flowing of the cleaning solution during flushing may be initiated by another component that turns flow on and off in response to a liquid pressure inside the fuel nozzle assembly being reached. This component may have a different pressure limit than the metering valve. In some embodiments, the fuel nozzle assembly may not even use a metering valve. In some examples, this other component that starts flushing fluid flow may be a component or system external to the fuel nozzle assembly (e.g., a release valve in manifold 116 that responds to a sensor pressure from a sensor associated with or mounted in fuel nozzle assembly 118).

In another embodiment, the component is a spray tip of a fuel nozzle assembly, and the solution flows through at least a portion of the spray tip during the flushing.

In one embodiment, the fuel nozzle assembly further comprises a spray tip, the spray tip includes inner cavities with residual debris from the ultrasonic cleaning, and the flowing of the solution removes at least a portion of the residual debris. The method further comprises flushing the fuel nozzle assembly or component with a calibration fluid.

Various non-limiting examples and additional embodiments are now described below. In a first example of a flushing process according to the above disclosure, solution tank 102 is filled with 1-2 gallons of a cleaning solution mixture. In one example, the cleaning solution may be an alkaline cleaning solution in a 50/50 mix with distilled water. In another example, the cleaning solution may be a carbon-removing solution. A fuel nozzle assembly that has been cleaned by ultrasonic cleaning is secured to fuel nozzle holder 112. In an alternative approach, a component of a fuel nozzle assembly, such as a metering set that has been ultrasonically cleaned, is mounted to a slave fuel nozzle assembly used solely for flushing.

Solution supply lines, such as tubes 114, are connected from manifold 116 to the fuel nozzle assemblies. Air supply valve 124 is opened to provide air pressure. Pressure gauge 126 is adjusted to, for example, 100-115 PSI. Pump valve 122 is then opened to begin flushing the fuel nozzle assemblies for a predetermined time. In one example, the flushing is performed for about 3-5 minutes when using the alkaline cleaning solution in the 50/50 mix (in some cases, after more than 5 minutes of flushing with this 50/50 mix, the solution may become too foamy for effective circulation as a fluid). Pump valve 122 is then closed to stop the solution flow.

After flushing, the primary orifice, and/or other physical features, of the metering set for a fuel nozzle assembly is inspected for debris (e.g., debris which remains from ultrasonic cleaning done prior to this flushing). If debris is identified, then the flushing process above can be continued again. When sufficient debris has been removed, or no debris is visible, then the fuel nozzle assemblies or the metering set itself, as is applicable, are removed from the cleaning system.

As optional additional steps, the cleaning solution is then drained from solution tank 102 and it is filled with 1-2 gallons of a calibration fluid. In one example, the calibration fluid may be a medium aliphatic solvent naptha. Now, using the calibration fluid instead of the cleaning solution, the foregoing steps of pressurizing and flowing fluid through the system are repeated. In one example, the flushing time when using the calibration fluid is about 3-10 minutes. The calibration fluid is used to prevent contamination of the fuel nozzle testing system.

After flushing with the calibration fluid above, the fuel nozzle assemblies or metering sets are removed from the cleaning system. The metering sets are then assembled into an overhauled fuel nozzle assembly, which is then tested prior to operational use.

In another example, the process above is used to flush residual debris from the fuel passages of a turboprop fuel nozzle after ultrasonic cleaning. The fuel nozzle is disassembled and the piece parts are ultrasonically cleaned during an overhaul process. After this ultrasonic cleaning, the spray tip of the fuel nozzles are assembled into non-production fuel nozzles that each get mounted in the cleaning system 100, as discussed above for the slave fuel nozzle assembly. Each fuel nozzle is flushed with a liquid detergent, as the flushing was described above, followed by a calibration fluid flush, each flush of which is pressurized and circulated from a reservoir by pneumatic pump. At a preset pressure value of a metering valve located within the fuel nozzle, the metering valve opens allowing cleaning detergent or calibration fluid to flow through the inner and outer passages of each fuel nozzle and spray tip.

In one embodiment, a fuel nozzle assembly has a preset fuel valve that is adjusted to open when a liquid pressure is at a certain value. In one example, the preset fuel valve is the metering valve discussed above, such as metering valve 402 of FIG. 4. Other types of fuel valves may be used in alternative embodiments.

In one embodiment, a metering set assembly (e.g., the metering set discussed above), which is also sometimes known as a spray tip assembly, includes an inner spray tip, an outer spray tip, a primary orifice, a secondary orifice, a director, and a spacer (e.g., such as illustrated in the fuel nozzle assembly of FIG. 4).

In one embodiment, the process of flushing the internal parts and cavities of the fuel nozzle assemblies allows for ultrasonic cleaning of the fuel nozzle assemblies without requiring disassembling of the fuel nozzles to remove residual debris prior to resuming operational use.

In one embodiment, inner cavities of the spray tip have trapped debris as a result of cavitation (i.e., microscopic bubbles that form and grow during ultrasonic cleaning). The bubbles implode and act as "scrub brushes", working in all directions, attacking every surface, and invading all recesses and openings. Debris liberated by a cleaning solution during ultrasonic cleaning may remain in the cavities of the metering set or other piece parts of the fuel nozzle assembly. Prior cleaning approaches do not permit effective flushing of the inner cavities of the metering set after ultrasonic cleaning. The flushing process described above may be used to remove at least a portion of this trapped debris. For example, the flushing process above removes entrapped debris from the internal cavities of the metering set. Thus, a complete fuel nozzle assembly can be flushed after ultrasonic cleaning without having to disassemble the fuel nozzle as with prior approaches.

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

What is claimed is:

1. A method, comprising:

cleaning a fuel nozzle assembly by ultrasonic cleaning;

after the ultrasonic cleaning, mounting the fuel nozzle assembly in a solution tank of a pressurized system, wherein the fuel nozzle assembly is mounted above a fluid level of a cleaning solution held in a solution tank; and flushing the mounted fuel nozzle assembly using the cleaning solution, wherein the solution flows through an interior of the fuel nozzle assembly.

2. The method of claim 1, wherein the fuel nozzle assembly comprises a valve located in the interior of the fuel nozzle assembly, and the valve opens to start the flowing of the cleaning solution when a preset pressure value of the valve is reached.

3. The method of claim 2, wherein the valve is a metering valve adjusted to open when a liquid pressure of the cleaning solution is at least a preset value.

4. The method of claim 1, further comprising flushing the interior of the fuel nozzle assembly with a calibration fluid.

5. The method of claim 1, wherein the fuel nozzle assembly further comprises a spray tip, the spray tip includes inner cavities with residual debris from the ultrasonic cleaning, and the flowing of the cleaning solution removes at least a portion of the residual debris.

6. The method of claim 1, wherein the fuel nozzle assembly further comprises a spray tip mounted to the fuel nozzle assembly.

7. The method of claim 1, wherein the fuel nozzle assembly further comprises a metering set, and the flushing comprises flushing inner cavities of the metering set.

8. The method of claim 7, wherein the flushing of the inner cavities of the metering set removes at least a portion of debris entrapped during the ultrasonic cleaning.

9. The method of claim 1, wherein the cleaning solution is a liquid detergent.

10. The method of claim 1, wherein the cleaning solution is pressurized during the flushing by providing the cleaning solution to the fuel nozzle assembly using a pump to flow the solution within the pressurized system, the system comprising a manifold overlying the solution tank, and the manifold receiving the cleaning solution from the pump and directing the cleaning solution to the fuel nozzle assembly during the flushing.

11. A method, comprising:

cleaning a fuel nozzle assembly or component by ultrasonic cleaning;

after the ultrasonic cleaning, mounting the fuel nozzle assembly or component in a solution tank, wherein the fuel nozzle assembly or component is mounted above a fluid level of a solution held in the solution tank; and flushing the mounted fuel nozzle assembly or component using the solution, wherein the solution flows through an interior of the fuel nozzle assembly or component.

12. The method of claim 11, wherein the solution is pressurized by providing the solution to the fuel nozzle assembly or component using a pump to flow the solution within a pressurized cleaning system that includes the solution tank.

13. The method of claim 12, wherein the cleaning system includes a manifold overlying the solution tank, the manifold to receive the solution from the pump and direct the solution to the fuel nozzle assembly or component during the flushing.

14. The method of claim 11, wherein the fuel nozzle assembly is flushed, and flowing of the solution through the interior of the fuel nozzle assembly begins after a pressurizing of the solution causes an opening of a metering valve of the fuel nozzle assembly.

15. A method, comprising:

after a fuel nozzle assembly or component has been cleaned by ultrasonic cleaning, mounting the fuel nozzle assembly or component in a solution tank of a pressurized system, wherein the fuel nozzle assembly or component is mounted above a fluid level of a cleaning solution held in the solution tank of the pressurized system; and flushing the fuel nozzle assembly or component by flowing the cleaning solution in the pressurized system.

16. The method of claim 15, wherein the fuel nozzle assembly is flushed, the fuel nozzle assembly comprises a metering valve located in an interior of the fuel nozzle assembly, the metering valve opens to start the flowing of the cleaning solution when the pressure is at least the preset value, and the cleaning solution flows through the interior of the fuel nozzle assembly.

17. The method of claim 15, wherein the component is flushed, the component is a spray tip, and the cleaning solution flows through at least a portion of the spray tip during the flushing.

18. The method of claim 15, wherein the fuel nozzle assembly is flushed, the fuel nozzle assembly further comprises a spray tip, the spray tip includes inner cavities with residual debris from the ultrasonic cleaning, and the flowing of the cleaning solution removes at least a portion of the residual debris.

19. The method of claim 15, further comprising flushing the fuel nozzle assembly or component with a calibration fluid.

20. The method of claim 15, wherein flowing of the cleaning solution through the fuel nozzle assembly or component is initiated when a pressure of the cleaning solution reaches at least a preset value.

* * * * *